US006828715B2

(12) United States Patent
Kim

(10) Patent No.: US 6,828,715 B2
(45) Date of Patent: Dec. 7, 2004

(54) OPTIMAL INNER SHIELD ASSEMBLY FOR SHIELDING AN EXTERNAL MAGNETISM IN A COLOR CATHODE RAY TUBE

(75) Inventor: Jae Yeul Kim, Daegu-si (KR)

(73) Assignee: LG Philips Displays Korea Co., Ltd., Gyeongsangbuk-do (KR)

( * ) Notice: Subject to any disclaimer, the term of this patent is extended or adjusted under 35 U.S.C. 154(b) by 0 days.

(21) Appl. No.: 10/157,813

(22) Filed: May 31, 2002

(65) Prior Publication Data

US 2003/0020392 A1 Jan. 30, 2003

(30) Foreign Application Priority Data

Jul. 25, 2001 (KR) ..... 2001-0044872

(51) Int. Cl.[7] ..... H01J 1/52; H01J 29/80
(52) U.S. Cl. ..... 313/407; 313/239
(58) Field of Search ..... 313/402, 479, 313/326, 352, 239, 407

(56) References Cited

U.S. PATENT DOCUMENTS 3,867,668 A * 2/1975 Shrader ..... 315/8
4,694,216 A * 9/1987 Morrell ..... 313/402
5,235,243 A * 8/1993 Tong ..... 313/479
5,763,990 A * 6/1998 Kwak ..... 313/402
5,880,555 A 3/1999 Park ..... 313/402
6,060,825 A * 5/2000 Kim ..... 313/479
6,144,149 A * 11/2000 Youn et al. ..... 313/407

* cited by examiner

*Primary Examiner*—Joseph Williams
*Assistant Examiner*—Peter Macchiarolo
(74) *Attorney, Agent, or Firm*—Birch, Stewart, Kolasch & Birch, LLP

(57) ABSTRACT

An inner shield assembly capable of maximizing an external magnetism shield effect. The inner shield assembly is provided at the rear side of a frame assembly for shielding external magnetism and includes a main body for shielding the inside of a funnel, a rectangular beam shield combined to the front of the main body and a front portion extending from the edge of the front of the beam shield around the outside of the shadow mask and the frame assembly. The material of the front portion has a maximum permeability of at least 3,000 and a coercivity of at most 1.25 Oe.

6 Claims, 14 Drawing Sheets

OPTIMAL INNER SHIELD ASSEMBLY FOR SHIELDING AN EXTERNAL MAGNETISM IN A COLOR CATHODE RAY TUBE

BACKGROUND OF THE INVENTION

1. Field of the Invention

The present invention relates to an inner shield assembly in a color cathode ray tube, more particularly to an inner shield assembly which is capable of minimizing an external magnetism and a variation of magnetism at the time of rotation of direction of the color cathode ray tube so that degradation of color purity of a screen can be prevented by improving a structure of the inner shield assembly and by optimizing magnetic characteristic of a component material of the improved inner shield assembly.

2. Description of the Related Art

FIG. 1 shows a partial sectional view for illustrating a structure of a general color cathode ray tube.

Referring to FIG. 1, the color cathode ray tube, which is primary element for displaying pictures in picture display devices such as television receivers and computer monitors, is generally comprised of a panel 1 provided at the front and a funnel 2 provided at the rear.

In addition, the inside of the flat cathode ray tube, which is divided by the panel 1 and the funnel 2, includes a fluorescent screen 3 that served as a light emission, an electron gun (not shown) provided in the inside a neck of the funnel 2 for projecting electron beams 11 for light-emitting the fluorescent screen 3, a shadow mask 4 for selecting color of electron beams 11 from the electron gun (not shown), a frame assembly 5 including a main frame 5*a* for applying tension to the shadow mask 4 and a sub-frame 5*b* for supporting the main frame 5*a*, a spring 6 provided at a side of the main frame 5*a* for combining the frame assembly 5 and the panel 1, an inner shield 7 welded and fixed to the sub-frame 5*b* for shielding an external earth magnetism, and a reinforcement band 10 provided at the side of the panel 1 for preventing an external impact.

Further, the outside of the neck of the funnel 2 has a deflection yoke 8 for deflecting up-and-down and left-and-right the electron beams 11 projected from the electron gun (not shown) and two, four and six pole magnets 9 for correcting traveling tracks of the electron so that the projected electron beams 11 hit accurately on a fluorescent substance, thereby degradation of color purity is prevented.

On the other hand, as shown in FIGS. 2 and 3, when electron beams projected from the electron gun (not shown) in the cathode ray tube are affected by an external magnetism, traveling direction of electron beams is changed and the electron beams do not correctly hit on desired fluorescent substance 3*a* of the fluorescent screen 3 but hit on a black matrix 3*b* or other fluorescent substance. This event is referred to as "mislanding". Accordingly, the inner shield 7 is used to shield affection by the external magnetism.

FIGS. 4*a* and 4*b* are a deployed view and an assembled view, respectively, for illustrating an example of an inner shield assembly structure of a conventional color cathode ray tube.

As shown in FIGS. 4*a* and 4*b*, the inner shield 7 comprises a pyramid-shaped main body 7*a* and a beam shield 7*b* combined to a forward end portion of the main body 7*a*. Also, the inner shield 7 is manufactured using material having a high permeability in order to minimize affection by an external magnetism.

FIGS. 5*a* and 5*b* are a deployed view and an assembled view, respectively, for illustrating another example of an inner shield assembly structure of a conventional color cathode ray tube.

As shown in FIGS. 5*a* and 5*b*, the inner shield 17 can be formed with an integration of a main body 17*a* with a beam shield 17*b*.

However, in a magnetism shield structure such as the conventional inner shields 7 and 17, it is not bonded to the sub-frame 5*b*, although the shadow mask 4 is bonded up-and-down to the main frame 5*a* of the frame assembly 5 such that the shadow mask has a portion of the magnetism shield function. Accordingly, since a large space is presented between the shadow mask 4 and the sub-frame 5*b*, there is a problem that the magnetism shield function cannot be performed in this space.

In addition, since an external magnetism shield effect is affected by the magnetic characteristic of material as well as the inner shield assembly structure, there is a need to adjust the magnetic characteristic of component material of the inner shield assembly in order to maximize the magnetism shield function.

SUMMARY OF THE INVENTION

Accordingly, the present invention has been made the aforementioned problems of the prior art in mind, and an object of the present invention is to provide an inner shield assembly which is capable of maximizing an external magnetism shield effect by improving a structure of the inner shield assembly and optimizing magnetic characteristic of component material of the improved inner shield assembly.

In order to accomplish the above object, according to the present invention, an inner shield assembly provided at the rear side of a frame assembly having a main frame and a sub-frame for shielding external magnetism including a main body for shielding the inside of a funnel, a rectangular beam shield combined to the front of the main body, and a front portion formed extending from the edge to the front of the beam shield around the outside of the shadow mask and the frame assembly, wherein material of the front portion has maximum permeability of at least 3000 and coercivity of at most 1.25 Oe.

Preferably, the magnetic characteristic of each of material is adjusted to have an interrelation of $0.5 \leqq \mu 2/\mu 1 \leqq 1.5$, where, maximum permeability of material of the main body is $\mu 1$ and maximum permeability of material of the front portion is $\mu 2$. In addition, the magnetic characteristic of each of material is adjusted to have an interrelation of $0.5 \leqq H1/H2 \leqq 3.0$, where, coercivity of material of the main body is H1 and coercivity of material of the front portion is H2. As a result, an optimal magnetism shield effect can be obtained.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
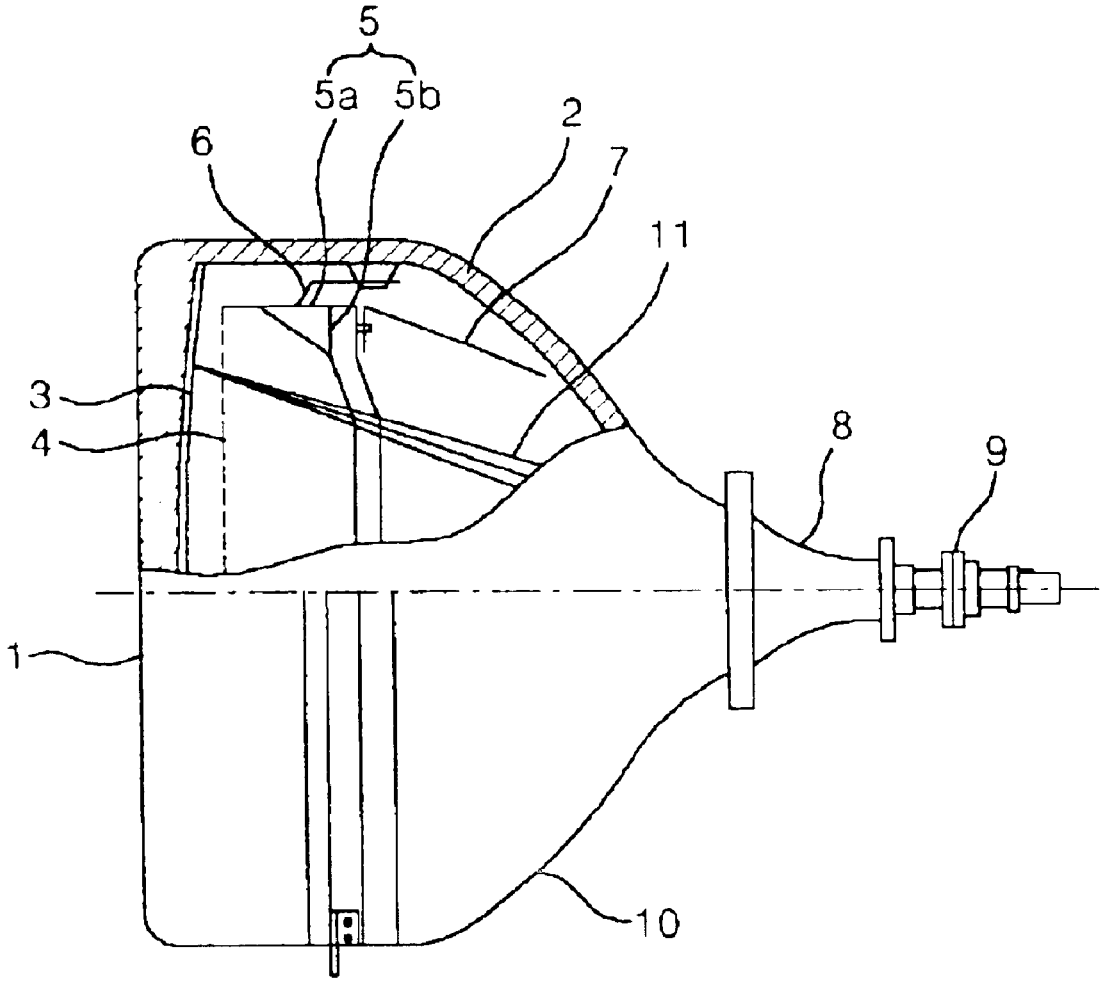
FIG.1 RELATED ART
FIG. 1 is a partial sectional view for illustrating a structure of a conventional color cathode ray tube.
Figure 2:
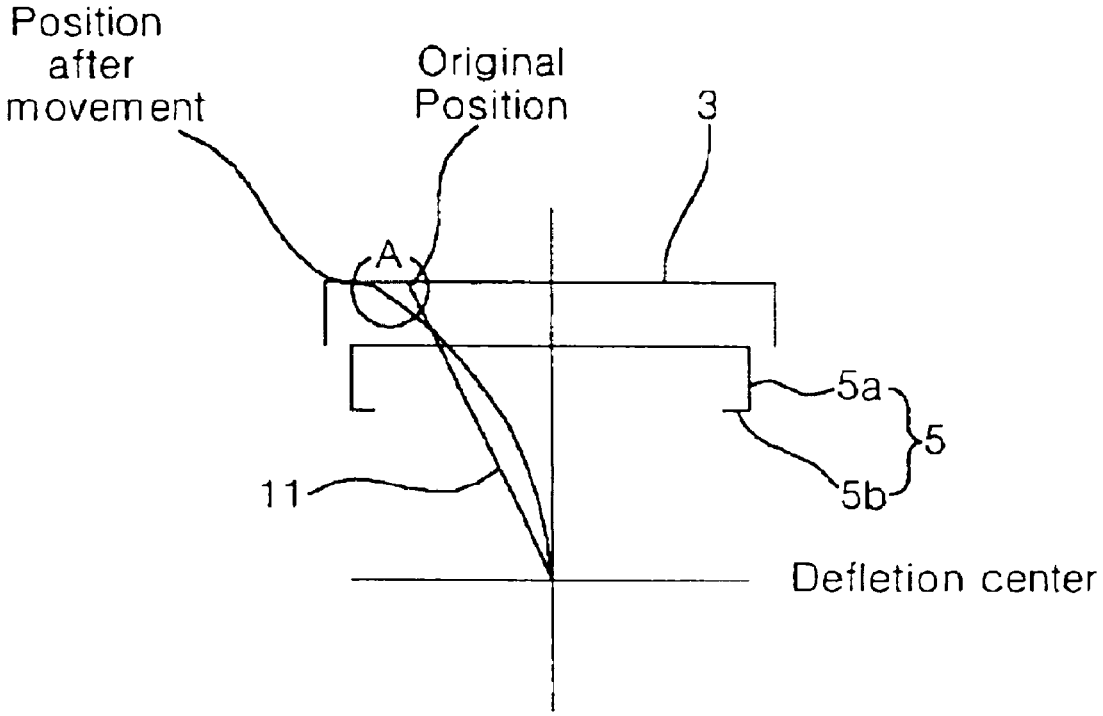
FIG.2 RELATED ART
FIG. 2 is a state diagram showing movement of electron beams by an effect of earth magnetism in a conventional color cathode ray tube.
Figure 3:
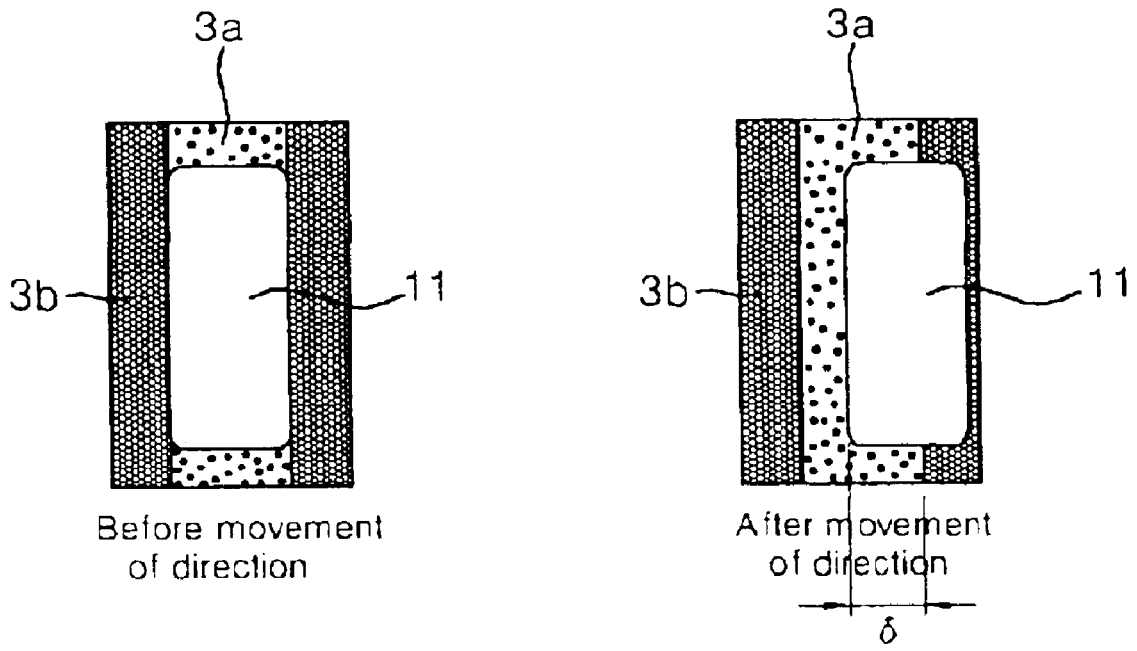
FIG.3 RELATED ART
FIG. 3 is a view showing a variation of electron beam landing position of A portion of FIG. 2.
Figure 4A:
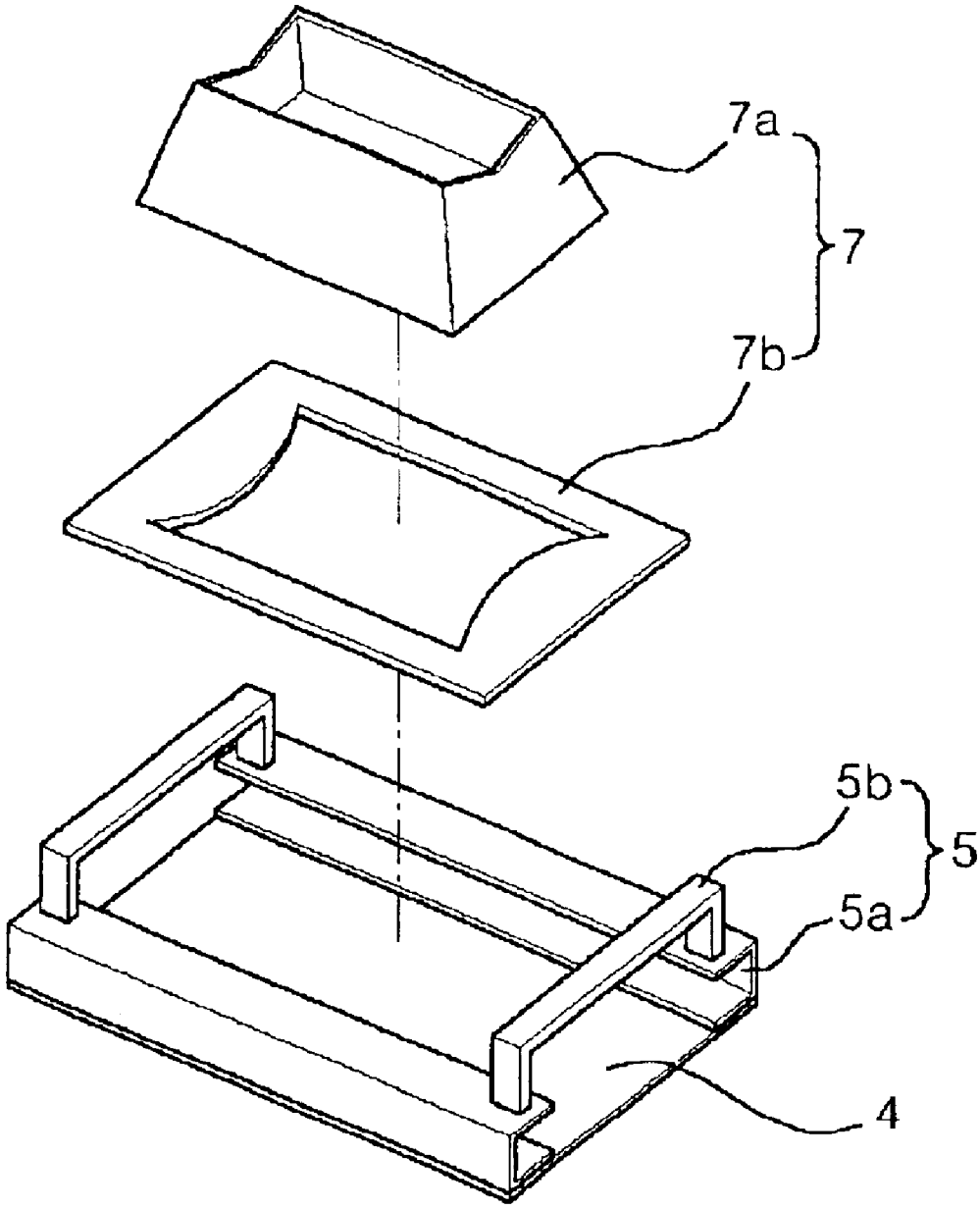
FIG 4a (Related Art)
FIGS. 4*a* and 4*b* are a deployed view and an assembled view, respectively, for illustrating an example of an inner shield assembly structure of a conventional color cathode ray tube.
Figure 4B:
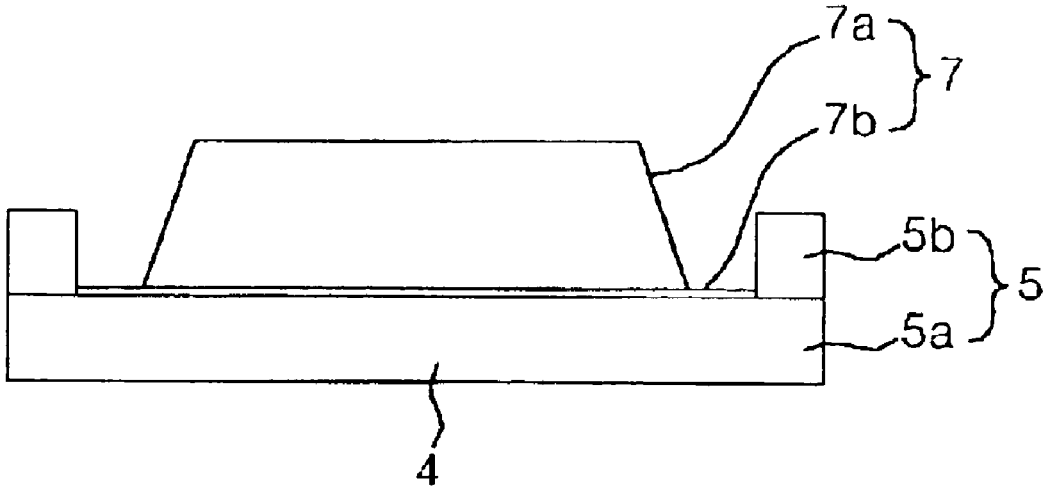
FIG 4b (Related Art)
Figure 5A:
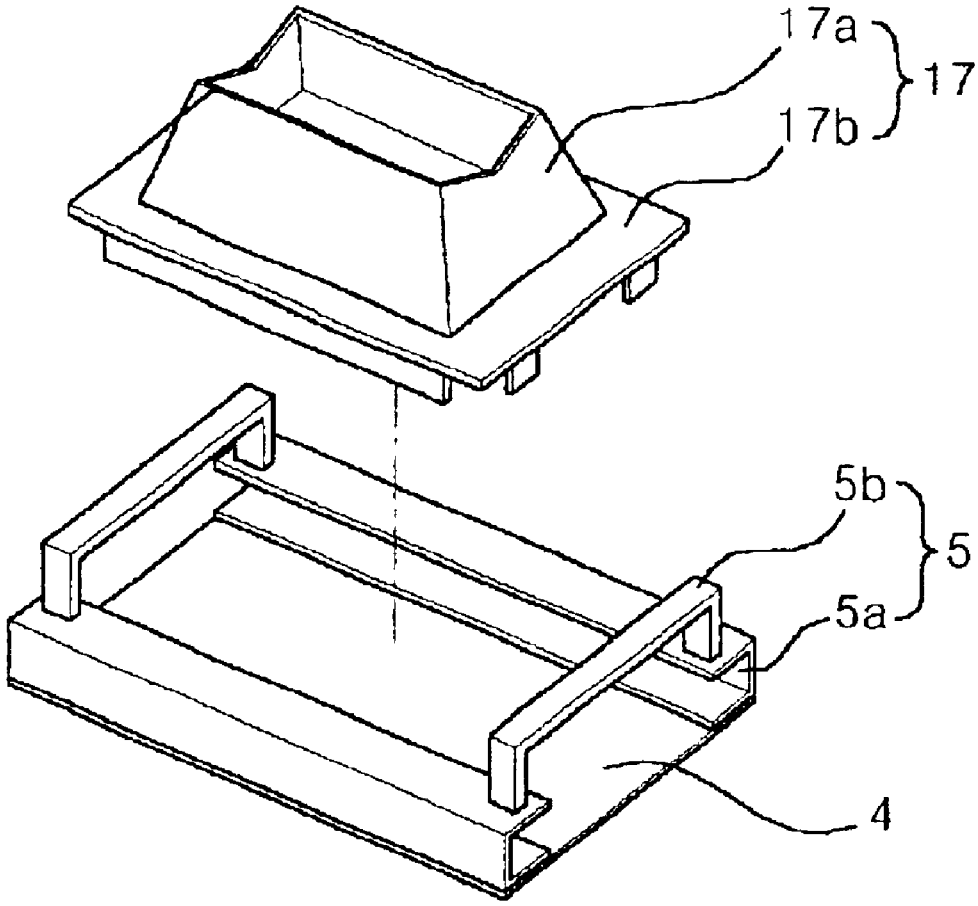
FIG 5 a (Related Art)
FIGS. 5*a* and 5*b* are a deployed view and an assembled view, respectively, for illustrating another example of an inner shield assembly structure of a conventional color cathode ray tube.
Figure 5B:
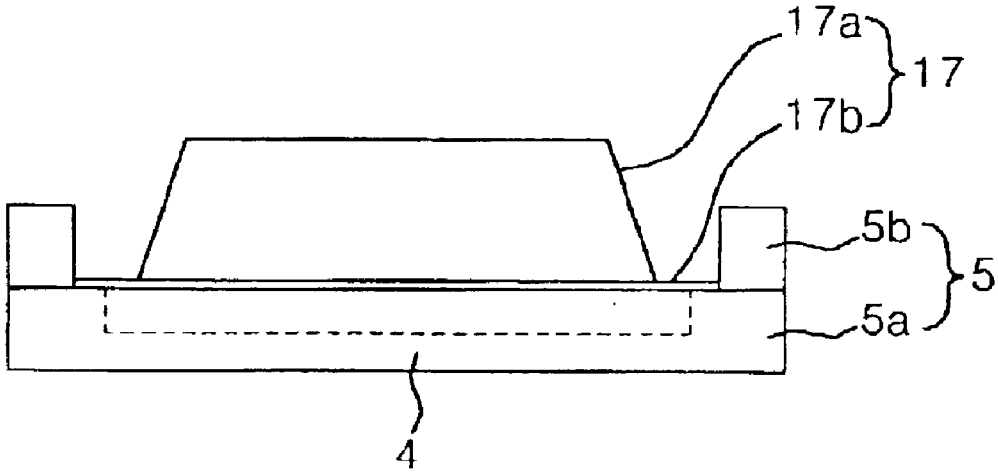
FIG 5b (Related Art)

Hereinafter, preferred embodiments of an inner shield assembly according to the present invention will be described in detail with respect to the accompanied drawings in which the same reference numerals are used throughout the different drawings to designate the same or similar components.

Figure 6A:
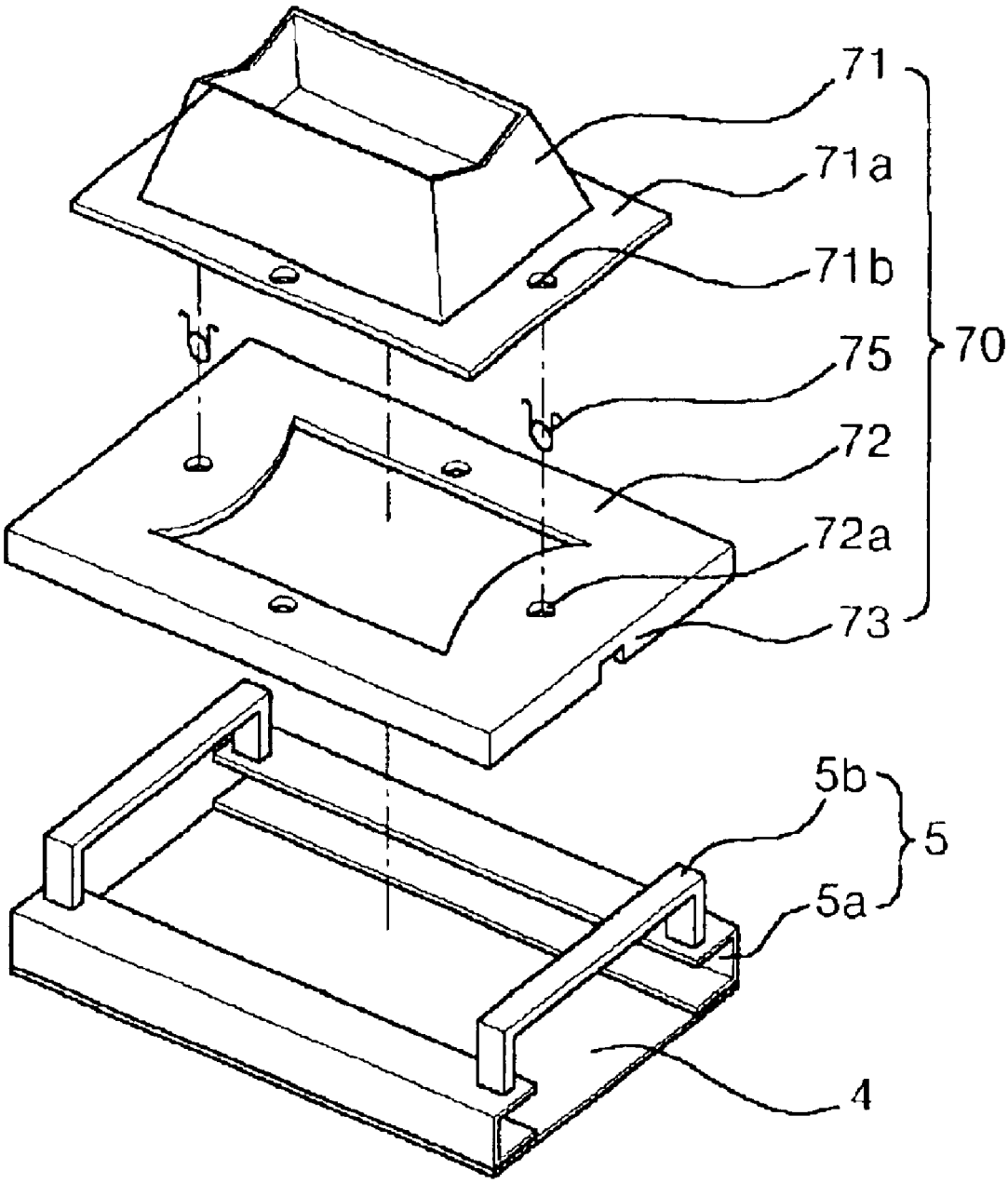
FIGS. 6*a* and 6*b* are a deployed view and an assembled view, respectively, for illustrating an inner shield assembly structure of a color cathode ray tube according to the present invention.
Figure 6B:
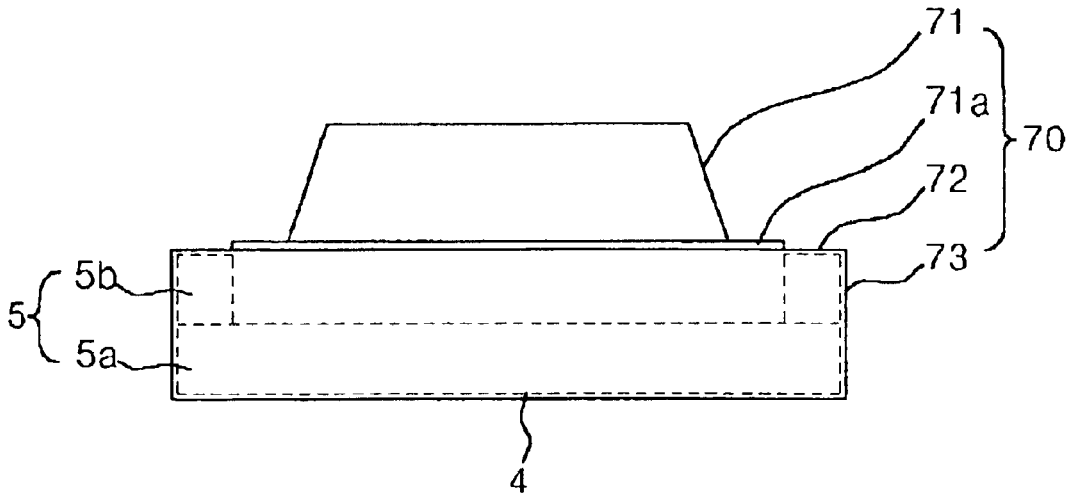

FIGS. 6*a* and 6*b* are a deployed view and an assembled view, respectively, for illustrating an inner shield assembly which is an external magnetism shield structure of a color cathode ray tube according to the present invention.

As shown in FIGS. 6*a* and 6*b*, an inner shield assembly 70 covers the inside of the funnel (2 in FIG. 1), the frame assembly 5 and the shadow mask 4 in the rear of the frame assembly 5 comprising the main frame 5*a* and the sub-frame 5*b*.

In addition, the inner shield assembly 70 generally comprises a rough pyramid-shaped main body 71 for shielding the inside of the funnel, a rectangular beam shield 72 combined to the front of the main body 71, and a front portion 73 formed extending from the edge to the front of the beam shield 72 around the outside of the shadow mask 4 and the frame assembly 5.

In addition, the beam shield 72 and front portion 73 of the inner shield assembly 70 are integrally formed and the main body 71 is attached to the beam shield 72 by means of a fixture pin 75 in a state that a combining hole 71*b* formed on a flange 71*a* of the main body 71 and a combining hole 72*a* of the beam shield 72*a* are aligned with registration.

On the other hand, an external magnetism shield effect is affected by thickness and magnetic characteristic of material, as well as the structure of the inner shield assembly 70. The present invention optimizes the magnetic characteristic of component material of the inner shield assembly in order to improve the magnetism shield function.

Accordingly, particularly, there is a need to limit permeability and coercivity of material of the front portion 73 and main body 71 of the inner shield assembly according to the present invention within a predetermined range.

Figure 7:
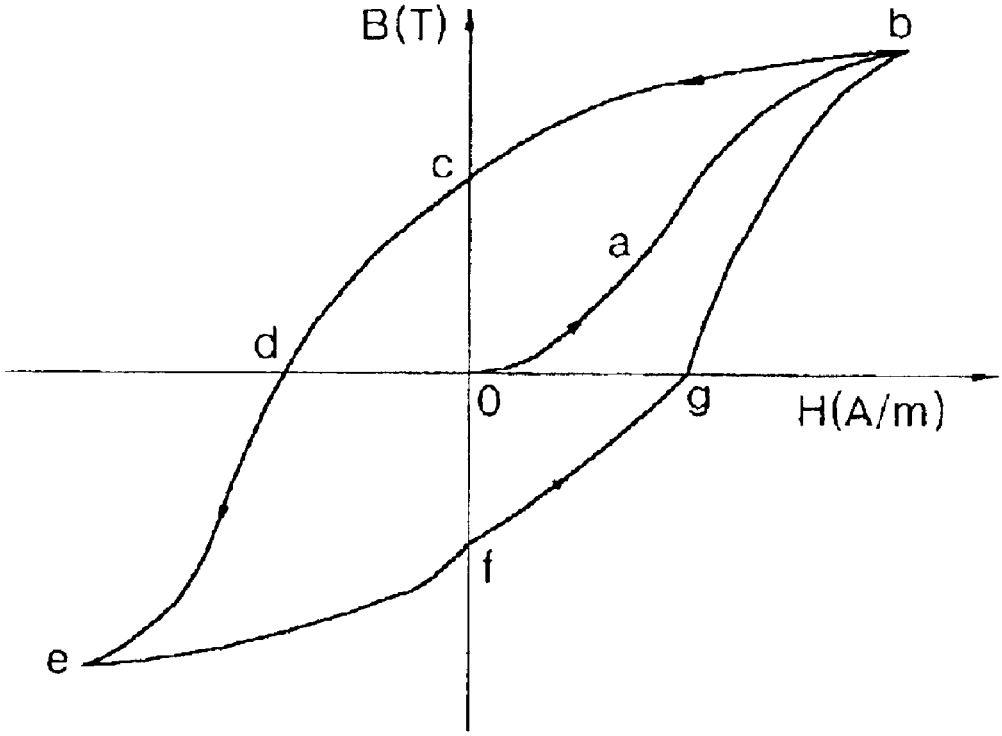
FIG. 7 is a graph showing a magnetic hysteresis loop for explaining permeability and coercivity of material employed in the present invention.

FIG. 7 is a graph showing a magnetic hysteresis loop for explaining permeability and coercivity of material employed in the present invention.

For the purpose of easy understanding, permeability and coercivity of the inner shield assembly of the cathode ray tube are briefly described with reference to FIG. 7 below.

When a magnetizing force H of ferromagnetic substance is increased to some degree, and after that, is decreased, a path that magnetic flux density B is increased when the magnetizing force is increased is not equal to a path that the magnetic flux density is decreased when the magnetizing force is decreased. And, when coercivity is decreased, the magnetic flux density is delayed. This phenomenon is referred to as "magnetic hysteresis" and a curve formed by the paths is referred to as "magnetic hysteresis loop".

In addition, in the magnetic hysteresis loop in FIG. 7, a curve (oab) is referred to as "normal induction curve", a magnetic flux density when H=0 is referred to as "residual magnetic flux density (Br)", and an absolute value of negative magnetizing force when B=0 is referred to as "coercivity(Hc)".

In addition, point (b) is referred to as "maximum magnetic flux density (Bm)", a magnetizing force corresponding to the point (b) is referred to as "maximum magnetizing force (Hm)", a curve (cd) is referred to as "demagnetizing curve", and product of a magnetic flux density by a magnetizing force at any point on the curve (cd) is referred to as "energy product".

In addition, a ratio of a magnetic flux density to a magnetizing force at any point on the normal induction curve is referred to as "normal permeability" and a maximum value of the normal permeability is referred to as "maximum permeability".

Figure 8:
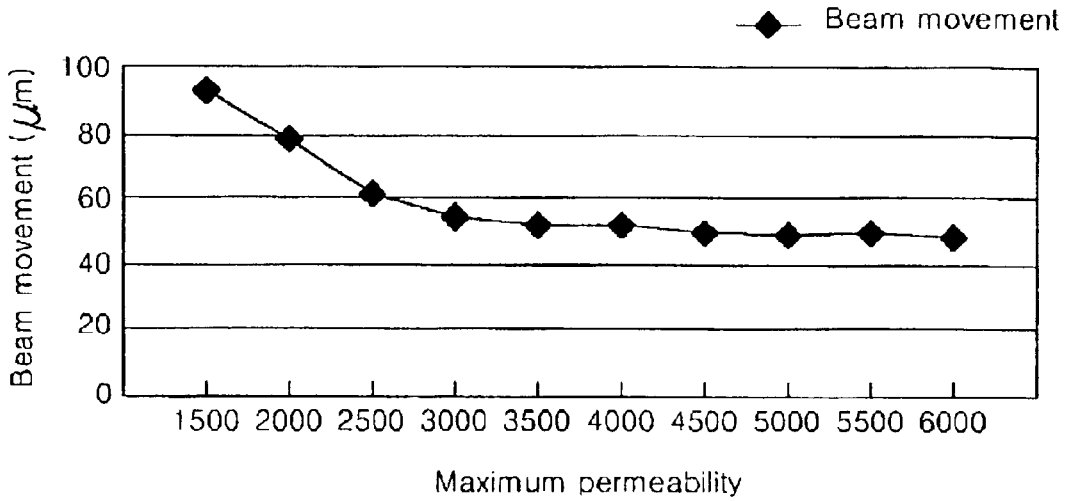
FIG. 8 is a graph showing a relation between beam movement and permeability of the front portion material of the inner shield assembly according to the present invention.
Figure 9:
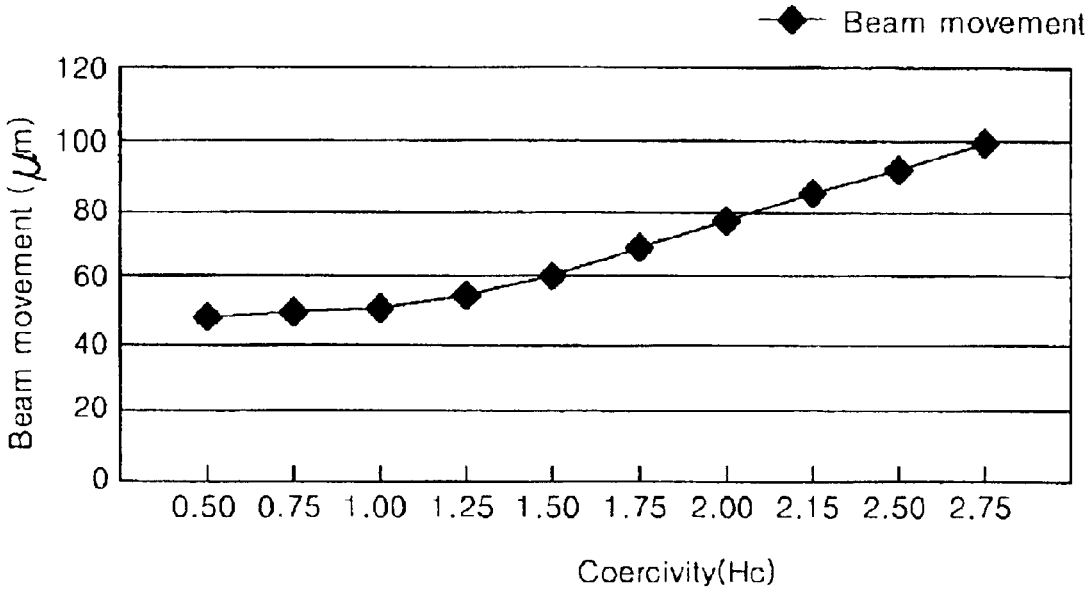
FIG. 9 is a graph showing a relation between beam movement and coercivity of the front portion material of the inner shield assembly according to the present invention.

FIG. 8 is a graph showing the relationship between the beam movement and permeability of the front portion material of the inner shield assembly according to the present invention, and FIG. 9 is a graph showing the relationship between the beam movement and coercivity of the front portion material of the inner shield assembly according to the present invention.

The meaning of the magnetism shield is not that magnetism is interrupted, but that an incoming magnetic field is decreased by concentrating magnetism on a material having a good magnetization. Particularly, the material having a good magnetization has a high permeability and a weak coercivity.

In order to prevent the electron beams from hitting on other colors at the time of rotation of direction of the color cathode ray tube so that color purity of a screen is maintained, an amount of movement of beams at the time of such a rotation due to an external magnetism, particularly, an earth magnetism, should be at most 60 $\mu$m.

Accordingly, as shown in the graphs of FIGS. 8 and 9, it is preferable that material of the front portion 73 has the maximum permeability of at least 3000 and coercivity of at most 1.25 Oe so that the front portion 73 shields the earth magnetism effectively.

Figure 10:
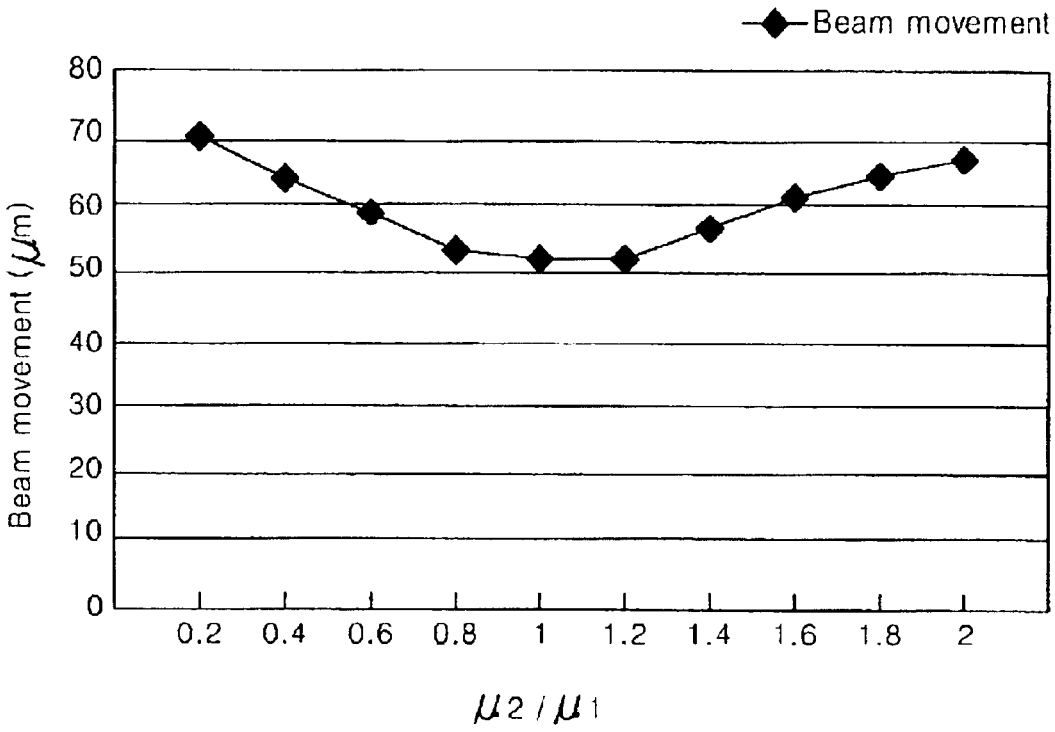
FIG. 10 is a graph showing a relation between beam movement and a ratio of permeability of the front portion to that of main body material of the inner shield assembly according to the present invention.
Figure 11:
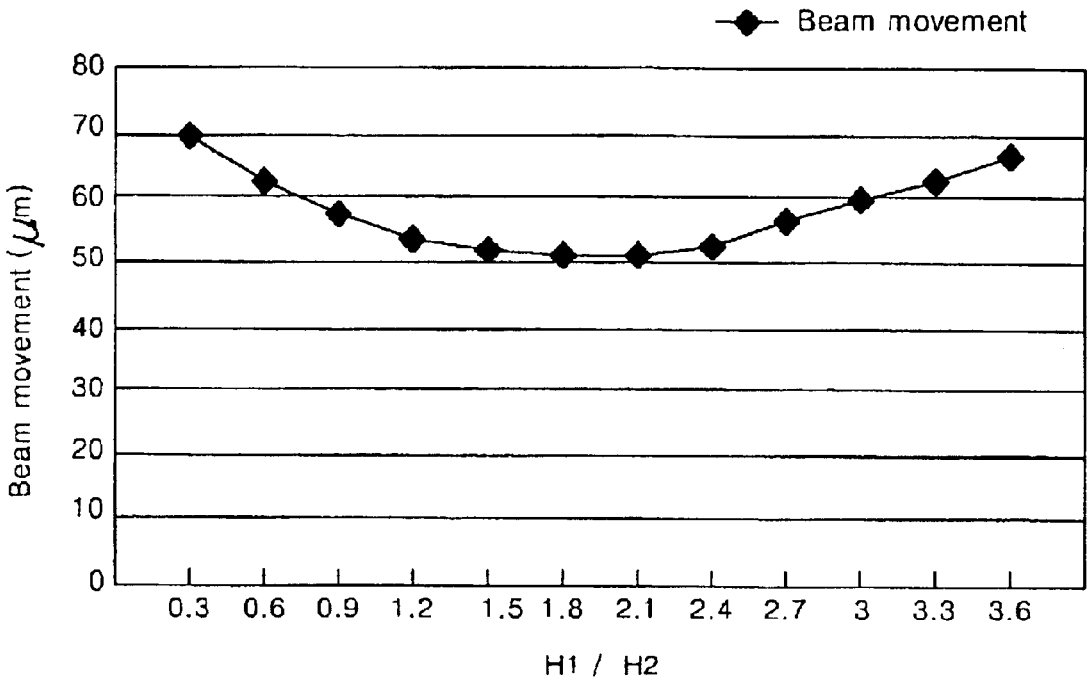
FIG. 11 is a graph showing a relation between the beam movement and a ratio of coercivity of the main body to that of front portion material of the inner shield assembly according to the present invention.

FIG. 10 is a graph showing a relationship between the beam movement and a ratio of permeability of the front portion to that of main body material of the inner shield assembly according to the present invention, and FIG. 11 is a graph showing a relationship between the beam movement and a ratio of coercivity of the main body to that of front portion material of the inner shield assembly according to the present invention.

Similar to the front portion 73, when material having a high maximum permeability and a low coercivity is used as the material of the main body 71, excellent shield effect can be obtained. However, since magnetism is concentrated on the shield material having a high permeability, it is not preferable that magnetic characteristic of material of the front portion 73 is greatly different from that of the main body 71.

Accordingly, as shown in FIGS. 10 and 11, it is required to limit the magnetic characteristic between the front portion 73 and the main body 71 within a predetermined range.

In other words, the magnetic characteristic of each of material is adjusted to have an interrelation of $0.5 \leqq \mu 2/\mu 1 \leqq 1.5$, where, maximum permeability of material of the main body 71 is $\mu 1$ and maximum permeability of material of the front portion 73 is $\mu 2$. In addition, the magnetic characteristic of each of material is adjusted to have an interrelation of $0.5 \leqq H1/H2 \leqq 3.0$, where, coercivity of material of the main body 71 is H1 and coercivity of material of the front portion 73 is H2. As a result, an optimal magnetism shield effect can be obtained.

As described above, according to the present invention, since the inner shield assembly extends around the outside of the shadow mask and the frame assembly, the magnetism shield function can be improved. In addition, since magnetic characteristic of material of each portion of the inner shield assembly is optimized, the magnetism shield effect may be enhanced.

Accordingly, a margin of directional rotation of the cathode ray tube can be increased and the color purity also can be maintained.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An inner shield assembly provided at the rear side of a frame assembly having a main frame and a sub-frame for shielding an external magnetism, comprising:

a main body for shielding the inside of a funnel;

a rectangular beam shield attached to the front of the main body; and a front portion formed extending from the edge to the front of the beam shield around the outside of a shadow mask and the frame assembly, wherein material of the front portion is different from the material of the main body and has a maximum permeability of at least 3000 in order to concentrate said external magnetism on a material having good magnetization.

2. The inner shield assembly according to claim 1, wherein material of the front portion has coercivity of at most 1.25 Oe.

3. The inner shield assembly according to claim 2, wherein a magnetic characteristic of each of material of said main body and said front portion has an interrelation of $0.5 \leqq \mu 2/\mu 1 \leqq 1.5$, where, the maximum permeability of material of the main body is $\mu 1$ and the maximum permeability of material of the front portion is $\mu 2$.

4. The inner shield assembly according to claim 2, wherein the magnetic characteristic of each of material of said main body and said front portion has an interrelation of $0.5 \leqq H1/H2 \leqq 3.0$, where, coercivity of material of the main body is H1 and coercivity of the material of the front portion is H2.

5. The inner shield assembly according to claim 1, wherein the magnetic characteristic of each of material of said main body and said front portion has an interrelation of $0.5 \leqq \mu 2/\mu 1 \leqq 1.5$, where, maximum permeability of material of the main body is $\mu 1$ and maximum permeability of material of the front portion is $\mu 2$.

6. The inner shield assembly according to claim 1, wherein the magnetic characteristic of each material of said main body and said front portion has an interrelation of $0.5 \leqq H1/H2 \leqq 3.0$, where, coercivity of material of the main body is H1 and coercivity of material of the front portion is H2.

* * * * *